US010619647B2

(12) United States Patent
Woehr et al.

(10) Patent No.: US 10,619,647 B2
(45) Date of Patent: Apr. 14, 2020

(54) GUIDE VANE FOR A DIFFUSER OF A RADIAL COMPRESSOR

(71) Applicant: Daimler AG, Stuttgart (DE)

(72) Inventors: Michael Woehr, Stuttgart (DE); Markus Mueller, Waiblingen (DE); Elias Chebli, Aidlingen (DE)

(73) Assignee: Daimler AG, Stuttgart (DE)

( * ) Notice: Subject to any disclaimer, the term of this patent is extended or adjusted under 35 U.S.C. 154(b) by 236 days.

(21) Appl. No.: 15/575,135

(22) PCT Filed: May 10, 2016

(86) PCT No.: PCT/EP2016/000762
§ 371 (c)(1),
(2) Date: Nov. 17, 2017

(87) PCT Pub. No.: WO2016/184548
PCT Pub. Date: Nov. 24, 2016

(65) Prior Publication Data

US 2018/0142701 A1 May 24, 2018

(30) Foreign Application Priority Data

May 20, 2015 (DE) ..... 10 2015 006 458

(51) Int. Cl.
*F04D 29/44* (2006.01)

(52) U.S. Cl.
CPC ..... *F04D 29/444* (2013.01); *F05D 2220/40* (2013.01); *F05D 2250/14* (2013.01); *F05D 2250/52* (2013.01)

(58) Field of Classification Search
CPC ..... F04D 29/444; F04D 29/44; F04D 29/42; F04D 29/441; F05D 2220/40; F05D 2250/14; F05D 2250/52
See application file for complete search history.

(56) References Cited

U.S. PATENT DOCUMENTS 1,792,015 A * 2/1931 Herrick ..... B64C 3/14 244/35 R
2,592,471 A * 4/1952 Sawyer ..... F04D 19/002 415/192
4,243,357 A * 1/1981 Flynn ..... F01D 5/048 415/218.1

(Continued)

FOREIGN PATENT DOCUMENTS

CN 102575688 B 11/2015
DE 20 2006 020 187 U1 1/2008

(Continued)

OTHER PUBLICATIONS

Japanese Office Action issued in Japanese counterpart application No. 2017-559831 dated Oct. 23, 2018, with partial English translation (Seven (7) pages).

(Continued)

*Primary Examiner* — Richard A Edgar
*Assistant Examiner* — Joshua R Beebe
(74) *Attorney, Agent, or Firm* — Crowell & Moring LLP

(57) ABSTRACT

A guide vane for a diffuser of a radial compressor which is arranged downstream of a receiving area for a compressor wheel is disclosed. The guide vane has a skeleton line where the skeleton line is elliptical at least in a sub-region.

5 Claims, 1 Drawing Sheet

(56) References Cited

U.S. PATENT DOCUMENTS

| | | | | | |
|---|---|---|---|---|---|
| 4,652,212 | A * | 3/1987 | Burger | F01D 5/048 | 416/188 |
| 5,152,661 | A * | 10/1992 | Sheets | F01D 5/145 | 415/84 |
| 6,589,013 | B2 * | 7/2003 | Abdallah | F04D 17/127 | 415/199.2 |
| 9,394,916 | B2 | 7/2016 | Small et al. | | |
| 2008/0038114 | A1 * | 2/2008 | Abdelwahab | F04D 29/444 | 415/211.1 |
| 2015/0300369 | A1 | 10/2015 | Sezal et al. | | |

FOREIGN PATENT DOCUMENTS

| | | | | |
|---|---|---|---|---|
| EP | 2 623 795 | A1 | 8/2013 | |
| JP | 2009-197614 | A | 9/2009 | |
| JP | 2012-219756 | A | 11/2012 | |
| JP | 2013-531187 | A | 8/2013 | |
| WO | WO 2006/053579 | A1 | 5/2006 | |
| WO | WO 2012/019650 | A1 | 2/2012 | |
| WO | WO 2012/140509 | A2 | 10/2012 | |
| WO | WO-2012140509 | A2 * | 10/2012 | F04D 29/444 |
| WO | WO 2014/072288 | A1 | 5/2014 | |

OTHER PUBLICATIONS

PCT/EP2016/000762, International Search Report dated Jul. 13, 2016 (Three (3) pages).

Chinese Office Action issued in Chinese counterpart application No. 201680028688.1 dated Nov. 29, 2018, with partial English translation (Seven (7) pages).

* cited by examiner

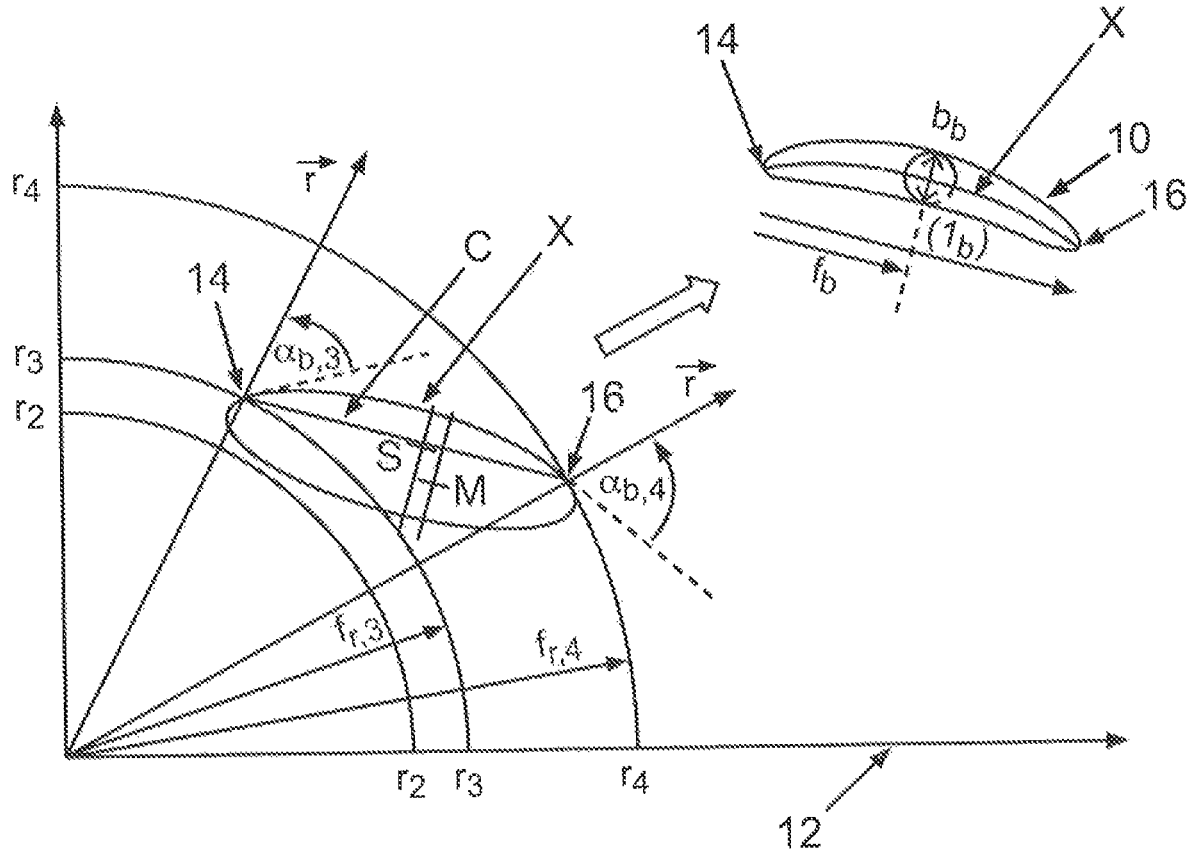
14
X
$b_b$
10
16
$(1_b)$
$f_b$
$r_4$
$\vec{r}$
C
X
14
$r_3$
$\alpha_{b,3}$
$r_2$
16
$\vec{r}$
S
M
$\alpha_{b,4}$
$f_{r,3}$
$f_{r,4}$
$r_2$
$r_3$
$r_4$
12

GUIDE VANE FOR A DIFFUSER OF A RADIAL COMPRESSOR

BACKGROUND AND SUMMARY OF THE INVENTION

The invention relates to a guide vane for a diffuser of a radial compressor.

Such guide vanes for diffusers of radial compressors are already well known from the general prior art. The radial compressor usually has a receiving region, in which a compressor wheel of the radial compressor can be received or—in the finished state of the radial compressor—is received. Furthermore, the radial compressor has a diffuser arranged downstream of the receiving region which extends, for example, at least substantially in a radial direction. During the operation of the radial compressor, air which flows off from the compressor wheel and flows through the diffuser is compressed by means of the compressor wheel.

The aforementioned guide vane can be arranged in the diffuser, which is constructed for example as a radial diffuser, or is arranged therein—in the finished state of the radial compressor—and serves for guiding the air flowing through the diffuser. In this case the guide vane has a skeleton line, wherein the guide vane can be constructed, for example, as an aerofoil.

Usually a plurality of guide vanes are arranged in the diffuser, being arranged in the circumferential direction of the compressor wheel successively over the circumference thereof. The plurality of guide vanes form a guiding means which is also designated as a discharge guide vane. The guiding means is arranged in the flow direction of the air downstream of the compressor wheel or of the receiving region and ensures advantageous flow conditions in the diffuser.

Furthermore, WO 2006/053579 A1 discloses a turbocharger having a turbine which comprises a turbine wheel and a guide vane assembly arranged upstream of the turbine wheel and having a plurality of guide vanes.

Conventional guide vanes, which are used in conventional radial compressors and are arranged or can be arranged in the diffuser, have vane geometries which lead to unfavorable and thus disadvantageous flow conditions in the diffuser. Such a vane geometry is, for example, a geometry in the form of a droplet profile, which leads to a substantial narrowing of the flow channel through which the air can flow, so that only a small maximum mass flow of the air can flow through the flow channel. A further vane geometry is the so-called NACA profile, which is optimized for aircraft wings, but creates high losses in the diffuser. A further vane geometry is the so-called wedge vane, which leads to substantial losses due to a sudden enlargement of the channel at the vane end. If the respective guide vane is configured, for example, as a straight vane with a constant thickness, this leads to an undesirably significant deceleration of the flow of air, resulting in high losses. A further vane geometry is the so-called circular arc geometry with a constant thickness. In this case there are only an insufficiently large number of free geometry parameters and this vane geometry leads to significant decelerations, in particular in the central part of the guide vane.

Therefore, the object of the present invention is to further develop a guide vane of the type mentioned above in such a way that particularly advantageous flow conditions can be obtained in the diffuser.

In order to further develop a guide vane in such a way that particularly advantageous flow conditions can be obtained in the diffuser, it is provided according to the invention that the skeleton line is configured elliptically at least in a part-region.

It has proved particularly advantageous if the entire skeleton line, that is to say along its entire extent, is configured elliptically. Due to the use of a guide vane with an elliptical skeleton line, an at least almost uniform deceleration in a flow channel delimited at least partially by the guide vane can be obtained without an excessive constriction occurring at the front edge of the vane. Furthermore, due to the use of a guide vane with an elliptical skeleton line there are a large number of free geometry parameters.

The invention also comprises a radial compressor, in particular for an exhaust gas turbocharger of an internal combustion engine, with a receiving region for a compressor wheel of the radial compressor, with a diffuser arranged downstream of the receiving region, and with at least one guide vane according to the invention arranged in the diffuser.

The diffuser per se is a flow channel through which air can flow, wherein the air is compressed by means of the compressor wheel, flows off from the compressor wheel and flows through the diffuser. Because the guide vane has at least one substantially elliptical skeleton line, particularly advantageous flow conditions can be obtained in the diffuser without excessive disadvantages, so that a particularly efficient operation of the radial compressor can be produced.

Further advantages, features and details of the invention can be seen from the following description of a preferred exemplary embodiment and with reference to the drawing. The features and combinations of features set out above in the description and the features and combinations of features set out below in the description of the drawing and/or shown in the single drawing can be used not only in the specified combination in each case, but also in other combinations or in isolation without departing from the scope of the invention.

BRIEF DESCRIPTION OF THE DRAWING

The drawing shows, in the single FIGURE, a schematic sectional view of a guide vane for a diffuser of a radial compressor, which diffuser is arranged downstream of a receiving region for a compressor wheel, with a skeleton line which is constructed elliptically at least in a part-region.

DETAILED DESCRIPTION OF THE DRAWING

The drawing shows, in a schematic sectional view, a guide vane designated overall by 10 for a diffuser of a radial compressor arranged downstream of a receiving region for a compressor wheel. The radial compressor is preferably a component of an exhaust gas turbocharger, with which an internal combustion engine, configured for example as a reciprocating internal combustion engine, of a motor vehicle is equipped. In this case the internal combustion engine is designed for driving the motor vehicle and comprises an exhaust gas system through which exhaust gas from the internal combustion engine can flow as well as an intake duct through which air can flow. The air flowing through the intake duct is guided by means of the intake duct into at least one combustion chamber, in particular a cylinder, of the internal combustion engine.

The exhaust gas turbocharger has a turbine which is arranged in the exhaust gas system and can be driven by the exhaust gas. For this purpose, the turbine includes a turbine housing as well as a turbine wheel which is arranged in the turbine housing and can be driven by the exhaust gas. The turbine wheel is rotatable about an axis of rotation relative to the turbine housing and is a component part of a rotor of the exhaust gas turbocharger. The rotor also includes the aforementioned compressor wheel as well as a shaft by which the turbine wheel and the compressor wheel are connected for conjoint rotation. In this way, the compressor wheel can be driven via the shaft of the turbine wheel, so that—during the operation of the radial compressor—air is compressed by means of the compressor wheel. As a result, energy contained in the exhaust gas can be used for compressing the air.

The radial compressor is arranged in the intake duct and comprises a compressor housing in which the compressor wheel is arranged. In this case, the compressor wheel or the rotor is rotatable about the axis of rotation relative to the compressor housing. The receiving region in which the compressor wheel is arranged is delimited by the compressor housing.

Furthermore, the radial compressor also includes the aforementioned diffuser, which is arranged in the flow direction of the air through the radial compressor downstream of the receiving region and thus of the turbine wheel. The diffuser is a channel through which the air compressed by the compressor wheel and flowing off from the compressor wheel can flow or through which the air flows during the operation of the radial compressor. The diffuser is preferably configured as a radial diffuser, wherein the diffuser extends at least substantially in the radial direction.

The radial compressor further includes a guiding means, which is also designated as a discharge guide vane assembly. The guiding means includes a plurality of guide vanes arranged in the diffuser and thus downstream of the receiving region or of the compressor wheel, of which the guide vane designated by 10 is shown in the drawing. The guide vanes arranged in the diffuser serve for guiding the air flowing through the diffuser, so that advantageous flow conditions can be obtained in the diffuser. The preceding and following statements relating to guide vanes 10 can be readily transferred to the other guide vanes of the discharge guide vane assembly.

It can be seen from the drawing that the guide vane 10 has a skeleton line X. In order now to be able to obtain particularly advantageous flow conditions in the diffuser, the skeleton line X is configured elliptically at least in a part-region. In the present case, it is provided that the entire skeleton line X is configured elliptically. This means that the skeleton line X along its entire extent is configured elliptically, that is to say it is configured as part of an ellipse.

The drawing also shows a diagram 12, which is used as a helpful diagram for designing the skeleton line X. It can be seen particularly clearly from the drawing that the skeleton line X of the guide vane 10 is designed as an ellipse with an elliptical thickening over the length of the chord C of the guide vane 10. In this case the guide vane 10 has a vane inlet 14, over which the air flows onto the guide vane 10 during the operation of the radial compressor. Furthermore, the guide vane 10 has a vane outlet 16, over which the air flows off from the guide vane 10. The vane inlet 14 and the vane outlet 16 intersect a common straight line and so define the chord C.

Since the skeleton line X is designed elliptically, the skeleton line X is also designated below as an ellipse. The ellipse has precisely two angles of intersection with the chord C, wherein the angles of intersection of the ellipse with the chord C of the guide vane 10 are in each case, that is to say when considered individually, less than 45° and jointly, that is to say in total, always less than 80°.

An inlet radius of the guide vane 10 is designated by $f_{r,3}$, wherein $f_{r,4}$ designates an outlet radius of the guide vane 10. The inlet radius is also illustrated in the drawing by $r_3$, wherein the outlet radius $f_{r,4}$ is also illustrated by $r_4$. Furthermore, a radius $r_2$, can be seen in the drawing. Furthermore, the guide vane 10 has an inlet angle $\alpha_{b,3}$ and an outlet angle $\alpha_{b,4}$, wherein the guide vane 10, in particular the inlet region thereof in which air flows onto the guide vane 10, encloses the inlet angle $\alpha_{b,3}$ with the radial. Furthermore, the guide vane 10, in particular the outlet region thereof over which air flows off from the guide vane 10, encloses the outlet angle $\alpha_{b,4}$ with the radial, wherein this radial is illustrated in the drawing in each case by $\vec{r}$.

Furthermore, the guide vane 10 has a maximum thickness $b_b$ and a so-called maximum thickness position $f_b$. Furthermore, the length of the chord C is designated by $l_b$. It has also proved particularly advantageous if the center point M of the ellipse with respect to the chord axis of the guide vane 10 does not lie further away from the center point S of the chord C than half the length $l_b$ of the chord C.

Due to the configuration of the guide vane 10 illustrated in the drawing, in a flow channel which is delimited at least partially by the guide vane 10 and through which air can flow, it is possible to obtain an at least substantially uniform deceleration without excessive constriction on the front edge of the vane, wherein simultaneously a particularly large number of free geometry parameters can be produced. In this way, a discharge guide vane assembly design with an elliptical characteristic can be created for the diffuser preferably configured as a radial diffuser, so that particularly advantageous flow conditions can be produced in the diffuser.

LIST OF REFERENCE CHARACTERS

10 guide vane
12 diagram
14 vane inlet
16 vane outlet
C chord
S center point
M center point
X skeleton line
db maximum thickness
fb maximum thickness position
fr3 inlet radius
fr4 outlet radius
l length
r2 radius
r3 inlet radius
r4 outlet radius
$\vec{r}$ Radial
αb,3 inlet angle
αb,4 outlet angle

The invention claimed is:

1. An air guide for a diffuser of a radial compressor, wherein the diffuser is disposed downstream of a receiving region for a compressor wheel, comprising:

a guide vane, wherein the guide vane has a skeleton line and wherein an entirety of the skeleton line is configured elliptically, wherein a vane inlet and a vane outlet of the guide vane intersect a common straight line and define a chord of the guide vane, wherein the skeleton line is an ellipse and wherein angles of intersection of the ellipse with the chord of the guide vane are in each case less than 45° and in total less than 80°, and wherein a distance of a center point of the ellipse from a center point of the chord of the guide vane with respect to a chord axis is at most half a length of the chord.

2. A radial compressor, comprising:

a receiving region for a compressor wheel of the radial compressor;

a diffuser disposed downstream of the receiving region; and an air guide according to claim 1 disposed in the diffuser.

3. The radial compressor according to claim 2, wherein the radial compressor is disposed in an exhaust gas turbocharger of an internal combustion engine.

4. An exhaust gas turbocharger of an internal combustion engine, comprising:

a radial compressor, wherein the radial compressor includes:

a receiving region for a compressor wheel of the radial compressor;

a diffuser disposed downstream of the receiving region; and a guide vane, wherein the guide vane has a skeleton line, wherein an entirety of the skeleton line is configured elliptically, and wherein the guide vane is disposed in the diffuser, wherein a vane inlet and a vane outlet of the guide vane intersect a common straight line and define a chord of the guide vane, wherein the skeleton line is an ellipse and wherein angles of intersection of the ellipse with the chord of the guide vane are in each case less than 45° and in total less than 80°, and wherein a distance of a center point of the ellipse from a center point of the chord of the guide vane with respect to a chord axis is at most half a length of the chord.

5. The exhaust gas turbocharger according to claim 4, wherein the exhaust gas turbocharger is disposed in a motor vehicle.

* * * * *